United States Patent [19]

Ikenaga et al.

[11] Patent Number: 4,667,350

[45] Date of Patent: May 26, 1987

[54] LAVATORY HOPPER FLUSHING APPARATUS

[75] Inventors: Takao Ikenaga; Toshifumi Shigematsu; Tatsumi Hamanaka, all of Chigasaki; Manabu Hirahara, Kitakyushu, all of Japan

[73] Assignee: Toto Ltd., Kitakyushu, Japan

[21] Appl. No.: 899,795

[22] Filed: Aug. 25, 1986

Related U.S. Application Data

[63] Continuation of Ser. No. 735,750, May 20, 1985, abandoned.

[30] Foreign Application Priority Data

May 25, 1984 [JP] Japan ..... 59-107333
Aug. 8, 1984 [JP] Japan ..... 59-166100

[51] Int. Cl.[4] ..... E03D 13/00

[52] U.S. Cl. ..... 4/304; 4/303; 4/DIG. 3

[58] Field of Search ..... 4/304, 305, 302, 623, 4/DIG. 3

[56] References Cited

U.S. PATENT DOCUMENTS

| | | | |
|---|---|---|---|
| 3,575,640 | 4/1971 | Ishikawa | 4/304 |
| 3,863,196 | 1/1975 | Hilles | 4/302 |
| 4,134,163 | 1/1979 | Matsunaga | 4/304 |
| 4,309,781 | 1/1982 | Lissau | 4/304 |
| 4,471,498 | 9/1984 | Robertshaw | 4/DIG. 3 |

FOREIGN PATENT DOCUMENTS 56-19420 5/1981 Japan .

*Primary Examiner*—Stephen Marcus
*Assistant Examiner*—L. J. Peters
*Attorney, Agent, or Firm*—Oblon, Fisher, Spivak, McClelland & Maier

[57] ABSTRACT

This invention relates to a lavatory hopper flushing apparatus, particularly, a lavatory hopper flushing apparatus comprising a sensor unit capable of detecting the use of any one of a plurality of lavatory hoppers arranged side by side, and providing a detection signal upon the detection of the use of any one of the lavatory hoppers; a control unit capable of being actuated by the detection signal; and a water supply unit capable of being driven by the control unit so as to flush all the lavatory hoppers simultaneously; wherein the control unit capable of being actuated by the detection signal given by a sensor unit and driving a water supply unit includes a counter control unit which has a counting circuit that counts the frequency of the detection signal and which provides an output signal when the count of the detection signals reaches a predetermined number, and an output control unit which provides an output signal to actuate the water supply unit, upon the reception of the output signal given by the counter control unit, whereby all the lavatory hoppers of a group is simultaneously flushed with water when the total number of times of the use of the lavatory hoppers of the group reaches a predetermined number.

13 Claims, 21 Drawing Figures

| FIG. 6A | FIG. 6B | FIG. 6C |
|---|---|---|

LAVATORY HOPPER FLUSHING APPARATUS

This application is a continuation of application Ser. No. 735,750, filed May 20, 1985, now abandoned.

BACKGROUND OF THE INVENTION

1. Field of the Invention

The present invention relates to a lavatory hopper flushing apparatus capable of automatically flushing lavatory hoppers upon the detection of the use of the lavatory hoppers.

2. Description of the Prior Art

Japanese Patent Publication No. 56-19420 discloses a lavatory hopper flushing apparatus of the above-mentioned type. This known lavatory hopper flushing apparatus comprises a sensor unit for detecting the use of lavatory hoppers, a control unit which operates on the basis of a detection signal given by the sensor unit, and a water supply unit adapted to be actuated by the output signal of the control unit so as to flush the lavatory hoppers. This control unit is designed to regulate appropriately the interval between the detection of the use of the lavatory hoppers and the supply of water for flushing and to ignore detection signals given during the predetermined interval.

This known lavatory hopper flushing apparatus, however, flushes the lavatory hoppers after a predetermined time from the first use of the lavatory hoppers during the predetermined interval, even if the lavatory hoppers are used by a plurality of people during the predetermined interval. Accordingly, the lavatory hoppers become foul and dirty immediately before the termination of the predetermined interval, which is unsanitary and offensive. Furthermore, the lavatory hoppers are not flushed and the sealing water evaporates if the lavatory hoppers are not used for a long time, and hence it is impossible to keep the lavatory hoppers clean.

SUMMARY OF THE INVENTION

Accordingly, the present invention has been made to achieve the following objects.

It is a first object of the present invention to provide a lavatory hopper flushing apparatus which flushes all the lavatory hoppers of a group simultaneously with water when the number of times of the use of the lavatory hoppers of the group reaches a predetermined number.

It is a second object of the present invention to provide a lavatory hopper flushing apparatus which flushes all the lavatory hoppers of a group simultaneously with water when the number of times of the use of the lavatory hoppers of the group reaches a predetermined number and also flushes all the lavatory hoppers of the group simultaneously with water after a predetermined interval from the first use of any one of the lavatory hoppers of the group even if the number of times of the use of the lavatory hoppers of the group is less than the predetermined number at the termination of the predetermined interval.

It is a third object of the present invention to provide a lavatory hopper flushing apparatus which flushes all the lavatory hoppers of a group simultaneously with water when the number of times of the use of the lavatory hoppers of the group reaches a predetermined number, flushes all the lavatory hopeps of the group simultaneously with water after a predetermined interval from the first use of any one of the lavatory hoppers of the group even if the number of times of the use of the lavatory hoppers of the group is less than the predetermined number at the termination of the predetermined interval and supplies water to the lavatory hoppers of the group when any one of the lavatory hoppers of the group is not used for an extended period of time, to prevent the exhaustion of the sealing water due to evaporation.

The first object is achieved by providing the control unit which is actuated on the basis of a detection signal given by the sensor unit to derive the water supply unit with a counter control unit which has a counting circuit capable of counting the detection signals and provides an output signal when the number of the detection signals reaches a predetermined number, and an output control unit which provides an output signal to actuate the water supply unit upon the reception of the output signal given by the counter control circuit.

The second object is achieved by providing the control unit with a counter control unit which has a counting circuit capable of counting the detection signals and provides a first output signal when the number of the detection signals reaches a predetermined number, a timer control unit which has a second timer circuit and provides a second output signal at the termination of the interval set by the second timer circuit, and an output control unit which provides an output signal to actuate the water supply unit upon the reception of the first output signal given by the counter control unit or the second output signal given by the timer control unit.

The third object is achieved by providing the control unit with a counter control unit which has a counting circuit capable of counting the detection signals and provides a first output signal when the number of the detection signals reaches a predetermined number, a timer control unit which has a second timer circuit capable of being started by the detection signal and provides a second output signal at the termination of the interval set by the second timer circuit, an output control unit which provides an output signal to actuate the water supply unit upon the reception of the first output signal given by the counter control unit or the second output signal given by the timer control unit, and a protective timer control unit which has a third timer circuit capable of being started by the detection signal and provides a third output signal at the termination of the interval set by the third timer circuit, and by constituting the control unit so as to actuate the water supply unit upon the generation of the third output signal when any output signal is not given even after the passage of a predetermined time from the generation of the first or second output signal.

DESCRIPTION OF THE PREFERRED EMBODIMENTS

Figure 1:
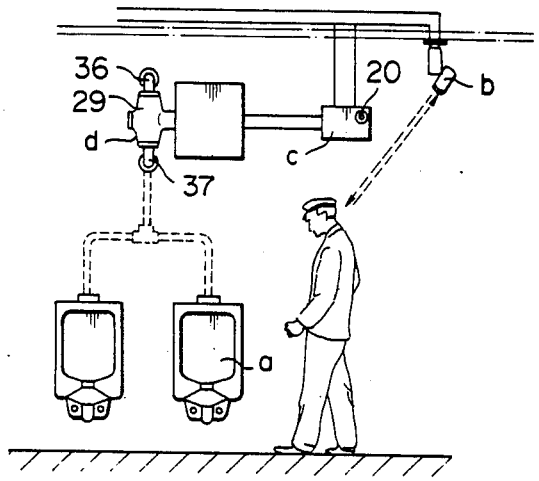
FIG. 1 is aschematic illustration of a lavatory hopper flushing apparatus, in a first embodiment, according to the present invention.

Referring to FIG. 1, there are shown a sensing unit b, a control unit c, a water supply unit d, and a plurality of lavatory hoppers a arranged side by side.

Figure 3:
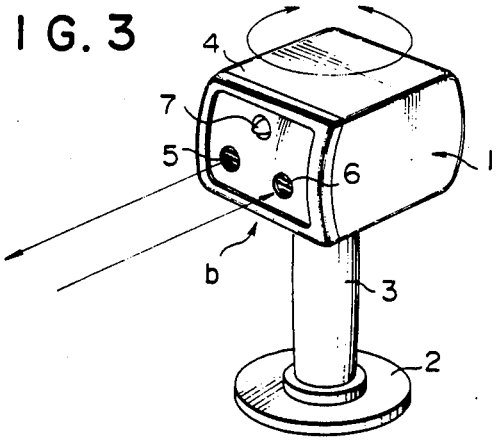
FIG. 3 is a perspective view of the sensor unit of the apparatus of FIG. 1.

The sensing unit b comprises a well-known photoelectric sensor of the reflected light measuring type. As shown in FIG. 3, the body 1 of the sensing unit b comprises a base 2, a leg 3 capable of turning in a horizontal plane, and a head 4 attached to the free end of the leg 3 so as to be turned in a vertical plane. The head 4 is equipped with a light projecting unit 5, a light receiving unit 5 and a pilot lamp 7. Thus, the light projecting angle of the sensing unit b can optionally be decided. The sensing unit b is attached to the ceiling in the vicinity of the lavatory hoppers a and projects infrared rays, visible rays or ultraviolet rays, but preferably infrared rays, in this embodiment, into a space where persons are expected to enter in using the lavatory hoppers a.

A portion of the infrared rays projected by the sensing unit b is diffused and reflected by the floor and the walls of the lavatory and the light receiving unit 6 receives the reflected rays of a fixed amount. When a person enters the space into which the infrared rays are projected, a large portion of the infrared rays is reflected or absorved by the person, and thereby the amount of the infrared rays received by the light receiving unit 6 changes, then the sensor unit gives a signal to the control unit c.

Figure 4:
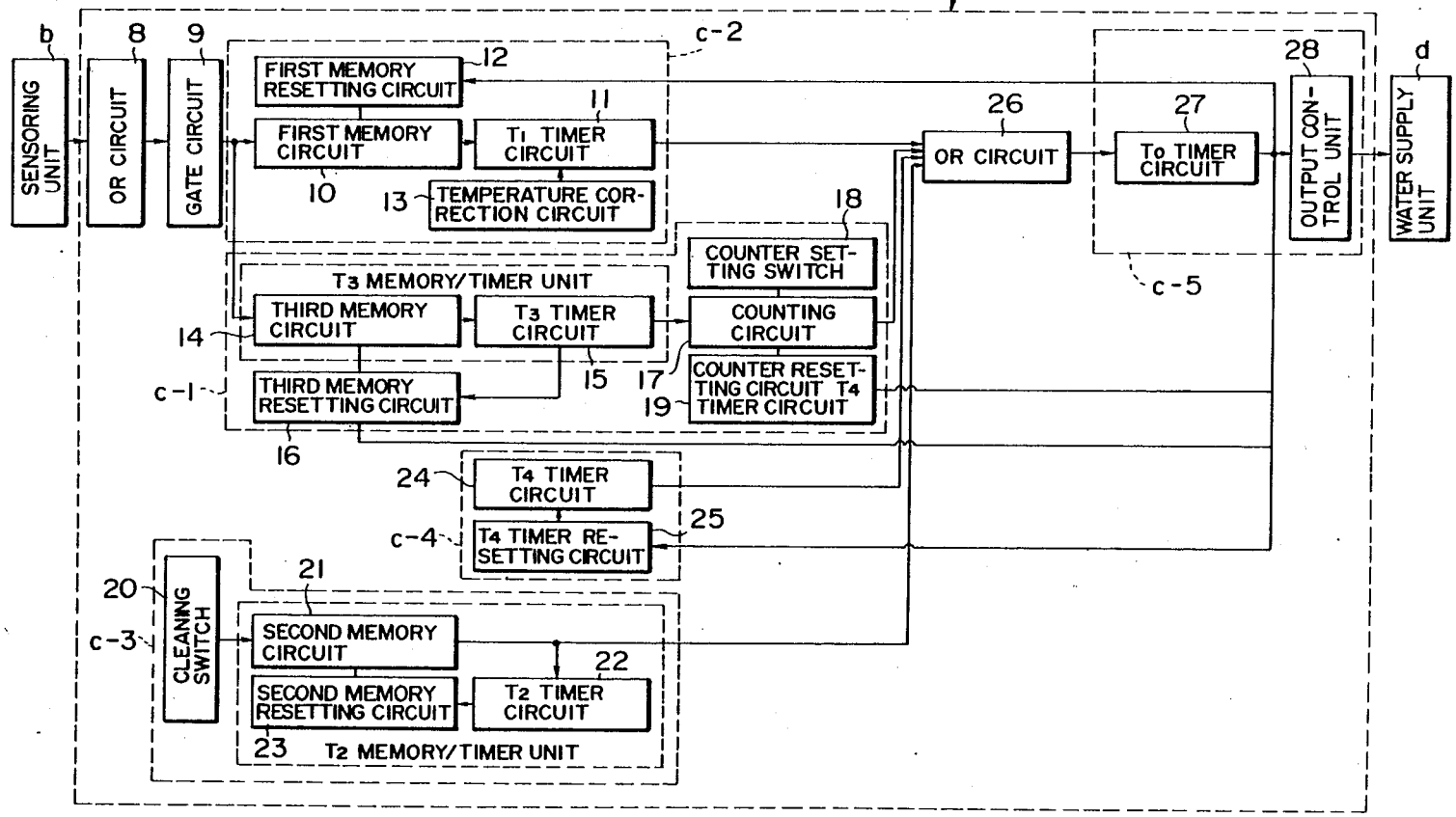
FIG. 4 is a block diagram showing the general constitution of the apparatus of FIG. 1.

Referring to FIG. 4, the control unit c comprises a counter control unit c-1, a timer control unit c-2, a switching unit c-3 for cleaning operation and a protective control unit c-4.

The timer control unit c-2 comprises a first memory circuit 10 which stores a detection signal given by the sensing unit b and transmitted thereto through an OR circuit 8 and a gate circuit 9, a $T_1$ timer circuit 11 which is actuated by a signal given by the first memory circuit 10 to operate for a time $T_1$ and gives a second output signal to a $T_0$ timer circuit 27, which will be described later, at the termination of the time $T_1$, a first memory circuit resetting circuit 12 which gives a signal to erase the memory of the first memory circuit to the first memory circuit 10 upon the reception of a signal given by the $T_0$ timer circuit 27, and a temperature correction circuit 13 which gives a signal to the $T_1$ timer circuit 11 to change the operating time of the $T_1$ timer circuit according to the ambient temperature.

The temperature correction circuit 13 has a CR timer consisting, for example, of a thermister, a condenser and others, and reduces the time $T_1$ when the ambient temperature is high and increases the timer $T_1$ when the ambient temperature is low so that the lavatory hoppers are washed at short intervals in the hot season as summer during which urine is decomposed within a short time. The time $T_1$ can be set at a suitable time, for example, a time between 1 and 20 minutes. The relation of the time $T_1$ to the ambient temperature is not dependent on any particular condition, only if the time $T_1$ is longer when the ambient temperature is lower and the time $T_1$ is shorter when the ambient temperature is higher.

The counter control unit c-1 comprises a third memory circuit 14 which stores the detection signal given thereto through the OR circuit 8 and the gate circuit 9, a $T_3$ timer circuit 15 which is actuated by a signal given by the third memory circuit 14 to operate for a time $T_3$ and gives a pulse signal at the termination of the time $T_3$ to actuate a third memory resetting circuit 16, which will be described later, the third memory resetting circuit 16 which gives a signal to erase the memory of the third memory circuit 14 upon the reception of the pulse signal given by the $T_3$ timer circuit 15, a counting circuit 17 which counts the pulse signals given by the $T_3$ timer circuit 15 and gives a first output signal to the $T_0$ timer circuit 27 when the count of the pulse signals reaches a predetermined number, a counter setting switch 18 which sets the predetermined number of pulse counts, and a counter resetting circuit 19 which resets the count of the counting circuit 17 to zero upon the reception of the signal given by the $T_0$ timer circuit 27.

The switching unit c-3 for cleaning operation comprises a cleaning switch 20 which gives an operation signal to actuate a second memory circuit 21, the second memory circuit 21 which stores the signal given thereto by the cleaning switch 20 and gives signals to the $T_2$ timer circuit 22 and to the $T_0$ timer circuit 27 upon the reception of the signal given by the cleaning switch 20, the $T_2$ timer circuit 22 which is actuated by a signal given by the second memory circuit 21 to operate for a time $T_2$ and gives a signal to actuate the second memory resetting circuit 23 at the termination of the time $T_2$, and the second memory resetting circuit 23 which erases the memory of the second memory circuit 21 upon the reception of a signal given by the $T_2$ timer circuit 22.

The protective control unit c-4 comprises a $T_4$ timer circuit 24 and a $T_4$ timer resetting circuit 25. When the $T_0$ timer circuit 27 is actuated and the output circuit 28 operates by the use of the lavatory hopper a or by turning on the cleaning switch 20, the $T_4$ timer resetting circuit 25 resets the $T_4$ timer circuit 24 to zero.

When the timing operation of the $T_0$ timer circuit 27 is terminated, The $T_4$ timer resetting circuit 25 is stopped and the $T_4$ timer circuit 24 is started.

The protective control unit c-4 starts the $T_0$ timer circuit 27 to actuate the output circuit 28 in order to prevent the evaporation of the sealing water of the lavatory hoppers a or to prevent the deposition of scales over the surfaces of the lavatory hoppers a when the lavatory hoppers a are not flushed for a long time. The $T_4$ timer circuit 24 is constituted so as to time the flushing interval at a suitable time, for example, at eight or twenty-four hours. The OR circuit 26, the $T_0$ timer circuit 27 and the output circuit 28 are connected commonly with the timer control unit c-2, the counter control unit c-1 and the switching unit c-3.

The $T_0$ circuit 27 receives the signal given by the counter control unit c-1, the signal given by the timer control unit c-2, the signal given by the signal given by the switching unit c-3 and the signal given by the protective control unit c-4 through the OR circuit 26, and gives an output signal for the time $T_0$ to actuate the first memory resetting circuit 12, the third memory resetting circuit 16, the counter resetting circuit 19 and the $T_4$ timer resetting circuit 25. The output circuit 28 amplifies the output signal of the $T_0$ timer circuit and applies the amplified output signal to the water supply unit d.

Figure 7:
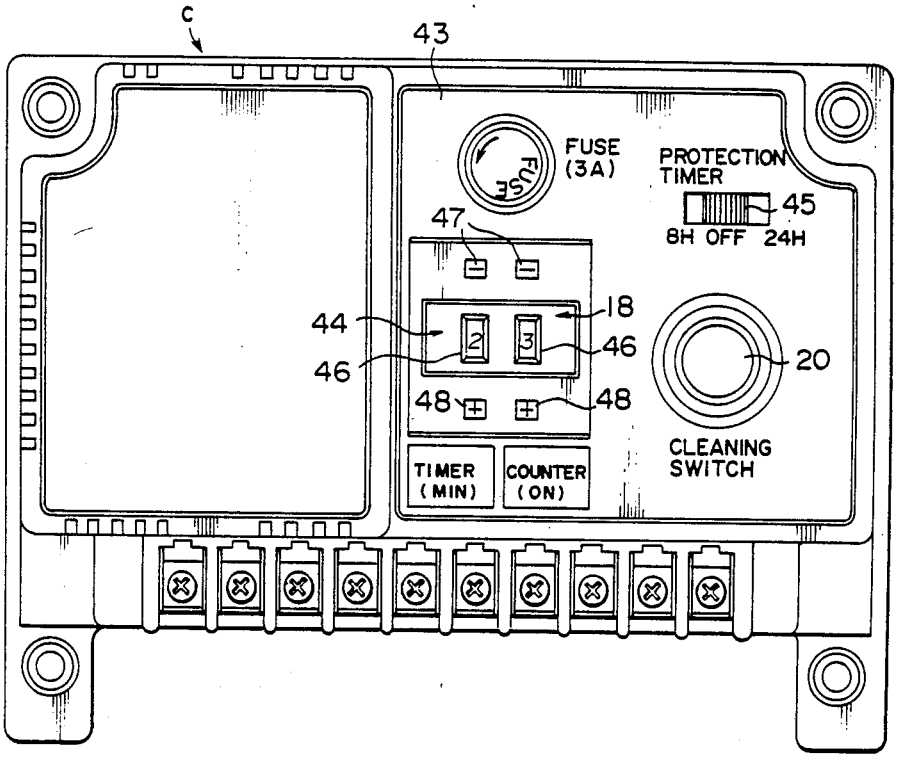
FIG. 7 is a front view of a control box accommodating the control unit of the apparatus of FIG. 1.

The component of the control unit c, namely, the counter control unit c-1, the timer control unit c-2, the switching unit c-3 and the protective control unit c-4, are accommodated in a box 43. As shown in FIG. 7, on the front panel of the box 43, the counter setting switch 18 for setting the count of the counting circuit 17 of the counter control unit c-1 and the timer setting switch 44 for setting the time $T_1$ of the timer circuit 27 of the timer control circuit c-2 are arranged side by side, and the push button of the cleaning switch 20 for actuating the second memory circuit 21 of the switching circuit c-3 and a selector switch 45 for selectively setting the $T_4$ timer circuit 24 of the protective control unit c-4 at an 8hr timing mode, an OFF mode or a 24hr timing mode are disposed.

The counter setting switch 18 and the timer setting switch 44 are so-called thumb rotary switches each having a display window 46 in the central part thereof, a subtraction push button 47 for decreasing the number indicated in the display window, disposed above the display window 46, and an addition push button 48 for increasing the number indicated in the display window, disposed below the display window 46.

Figure 2:
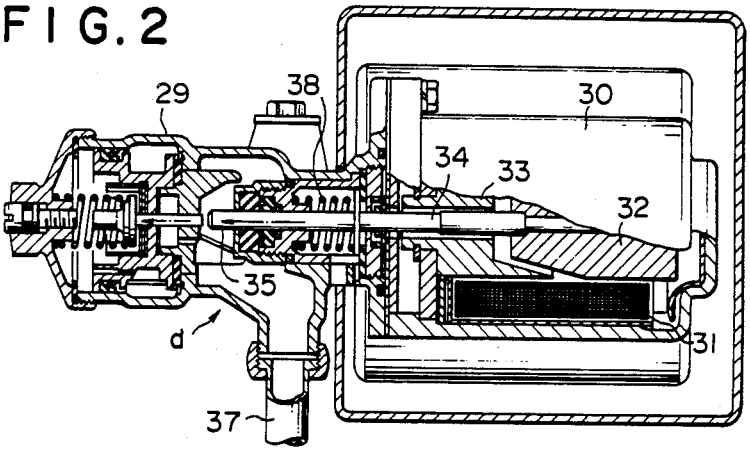
FIG. 2 is a sectional view of the water supply unit of the apparatus of FIG. 1.

Referring to FIG. 2, the water supply unit d is a well-known electromagnetic flush valve having an integral combination of a flush valve 29 and a driving electromagnet 30. The inlet of the flush valve 29 is connected through a water supply pipe 36 to a water supply source and the outlet of the same is connected through a flushing pipe 37 to the lavatory hoppers a. When the output of the control unit c is given to the water supply unit d, a plunger 32 is attracted to a fixed iron core 33 by the electromagnetic force of the coil 31 of the electromagnet 30, and thereby a push rod 34 formed integrally with the plunger 32 is advanced to push the actuating lever 35 of the flush valve 29 so that water is supplied to the lavatory hoppers a. When the output of the control unit c is stopped after the duration of the time $T_0$, the push rod 34 is released from the pressure and the actuating lever 35 is retracted by the resilient force of a spring 38. Thus the flush valve 29 stops supplying water after flushing the lavatory hoppers a with an amount of water for on flushing cycle. The actions of this lavatory hopper flushing apparatus will be described hereinafter.

Upon the detection of the use of the lavatory hopper a, the sensing unit b provides a detection signal. The detection signal is transmitted through the OR circuit 8 and the gate circuit 9 to the first memory circuit 10 of the timer control unit c-2 and to the third memory circuit 14 of the counter control unit c-1. Then, the first memory circuit 10 actuates the $T_1$ timer circuit 11.

On the other hand, the detection signal sets the third memory circuit 14 whereby the third memory circuit 14 stores the detection signal and actuates the $T_3$ timer circuit 15, which can be set at a time from 15 to 60 seconds. The third memory circuit 14 remains set and does not accept any further detection signal while the same is set.

After the passage of an overlap sensing preventing time $T_3$ from the actuation of the $T_3$ timer circuit 15, the timing operation of the $T_3$ timer circuit 15 is terminated and a pulse signal is provided to actuate the third memory resetting circuit 16. Then, the third memory resetting circuit 16 erases the memory of the third memory circuit 14, and thereby the third memory circuit 14 is reset for the reception of a new detection signal.

The counting circuit 17 counts the pulse signals and provides a first output signal to actuate the $T_0$ timer circuit 27 when the count reaches a predetermined number, for example, a number from 1 to 20 (3, in this embodiment), set by means of the counter setting switch 18. During the operation of the $T_0$ timer circuit 27, namely, for a time $T_0$, the output circuit 28 provides an output continuously to actuate the water supplying unit d so that all the lavatory hoppers a are flushed. Thus, each time when the total number of use of either any one or some of a plurality of the lavatory hoppers a becomes three, all the lavatory hoppers a of the group are flushed simultaneously. Accordingly, a problem that the lavatory hoppers a are flushed merely periodically at predetermined intervals, notwithstanding the lavatory hoppers a are used frequently can be solved.

On the other hand, when the $T_0$ timer circuit 27 operates, the counter resetting circuit 19 operates to reset the count of the counting circuit 17 at zero and, at the same time, the first memory resetting circuit 12 erases the memory of the first memory circuit 10 and reset the $T_1$ timer circuit 11 at zero.

As apparent from what has been described hereinbefore, the $T_0$ timer circuit 27 and the output circuit 28 constitute an output control unit c-5.

When the count of the counter control unit c-1 does not reach a predetermined number, three, in this embodiment, in the time $T_1$, the timing operation of the timer control unit c-2 is terminated and the timer control unit c-2 provides a second output signal to actuate the $T_0$ timer circuit 27, and thereby the counter resetting circuit 19 is actuated to reset the counting circuit 17 at zero, and the output circuit 28 provides an output.

Thus, when the number of use of any one or some of a plurality of the lavatory hoppers a is less than three times in a predetermined interval from the first detection of the use of the lavatory hopper a after the preceding flushing operation, all the lavatory hoppers a are flushed simultaneously, even if the number of times of the use of the lavatory hoppers a is less than three times. Accordingly, the lavatory hoppers a are flushed as soon as the lavatory hoppers a have been used by a predetermined number of times, while the lavatory hoppers a are flushed by a minimum necessary frequency when the lavatory hoppers a are used less frequently, so that the lavatory hoppers are kept clean.

When it is necessary to clean the lavatory hoppers a regardless of the detection of the use of the lavatory hoppers a, the cleaning switch 20 of the switching unit c-3 is operated to actuate the second memory circuit 21. The second memory circuit 21 stores the information of operation of the cleaning switch 20 and actuates the $T_2$ timer circuit 22 and the $T_0$ timer circuit 27, and thereby the output circuit 28 operates for the time $T_0$ to drive the water supply unit d. The operation of the $T_0$ timer circuit 27 resets the $T_1$ timer circuit 11 and the counting circuit 17 at zero. On the other hand, at the termination of the timing operation of the $T_2$ timer circuit 22, the second memory resetting circuit 23 is actuated to erase the memory of the second memory circuit 21 so that the apparatus is ready for the next operation of the cleaning switch 20. Thus, once the cleaning switch 20 is operated, a first operation signal indicating the operation of the cleaning switch 20 is stored by the second memory circuit 21 and a flushing operation is carried out, however, the second memory circuit 21 does not accept successive operation signals while the first operation signal is stored by the second memory circuit 21, even if the cleaning switch is operated repeatedly while the first operation signal is stored, and hence the flushing operation is not repeated if the cleaning switch 20 is operated. This time $T_2$ is designated herein as an prohibition time, which is a time in the range of 10 to 30 seconds. If the cleaning switch 20 is operated again after the timing operation of the $T_2$ timer circuit 22 has been terminated and the memory of the second memory circuit 21 has been erased by the second memory resetting circuit 23, the flushing operation is carried out.

In the protective control unit c-4, when the lavatory hopper a is used or the cleaning switch 20 is operated and the $T_0$ timer circuit 27 is actuated to operate the output circuit 28, the $T_4$ timer resetting circuit 25 is actuated to reset the $T_4$ timer circuit 24. At the termination of the timing operation of the $T_0$ timer circuit 27, the $T_4$ timer resetting circuit 25 is stopped and the $T_4$ timer circuit 24 is started. The time $T_4$ is designated herein as a protection time.

If the $T_0$ timer circuit 27 is started by the detection of the use of the lavatory hoppers a or by the operation of the cleaning switch 20 before the termination of the timing operation of the $T_4$ timer circuit 24, the $T_4$ timer circuit 24 is reset by the $T_4$ timer resetting circuit 25. If the $T_0$ timer circuit 27 is not actuated for a long time during a particular period, such as during the nighttime, the $T_0$ timer circuit 27 is actuated at the termination of the timing operation of the $T_4$ timer circuit 24 to flush the lavatory hoppers a. Accordingly, the water supply unit d is operated to flush the lavatory hoppers a even if the lavatory hoppers a are not used at all for an extended period of time. Therefore, it is possible not only to prevent the intrusion of offensive odors and injurious organisms into the lavatory through the draining pipe due to the exhaustion of the sealing water of the lavatory hoppers a by evaporation, but also to prevent the surface of the lavatory hoppers a and the draining pipes from drying and to obviate the deposition of scales and slimes in the lavatory hoppers a and the draining pipes, so that the lavatory facilities are protected from deterioration.

Simultaneously with the start of the $T_0$ timer circuit 27, the $T_4$ timer resetting circuit 25 resets the $T_4$ timer circuit 24. At the termination of the timing operation of the $T_0$ timer circuit 27, the $T_4$ timer circuit 24 is started again.

Figure 5:
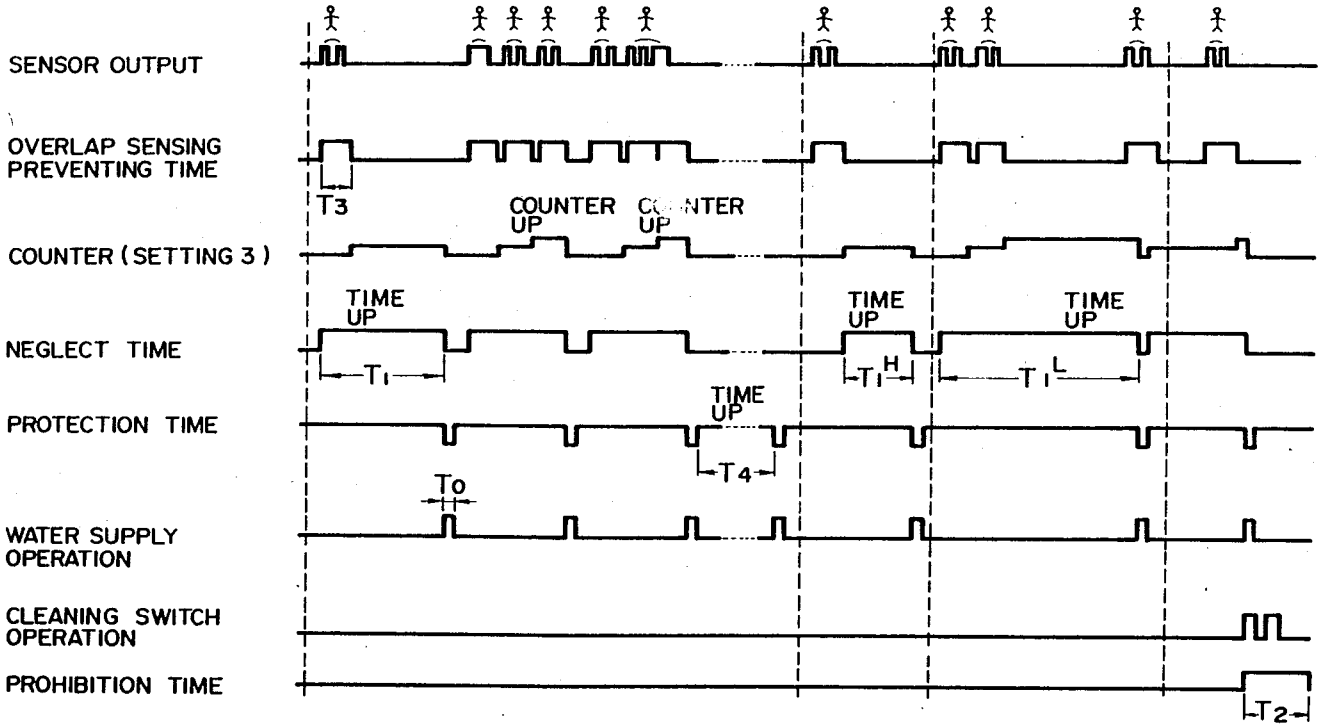
FIG. 5 is a time chart showing a mode of operation of the apparatus of FIG. 1.
Figures 6, 6A:
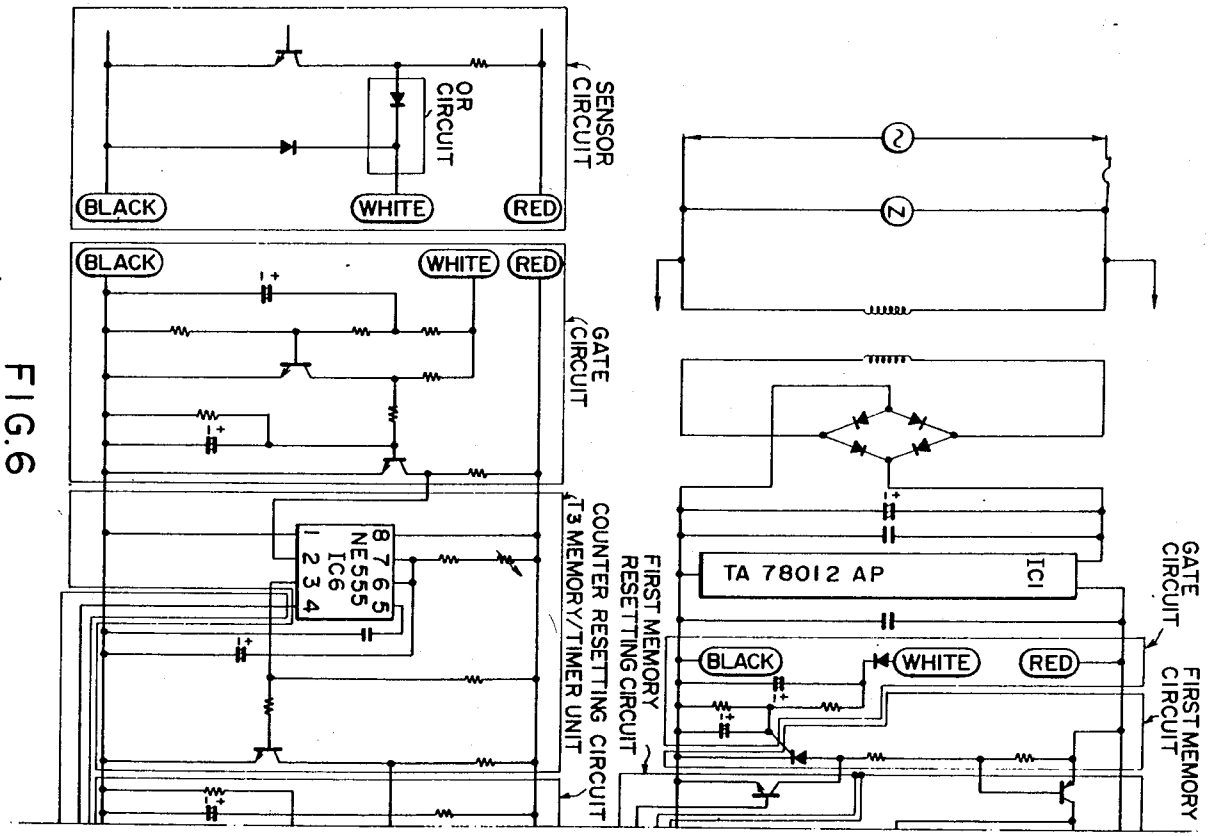
FIGS. 6, 6*a*, 6*b*, and 6*c* taken together are a circuit diagram of the apparatus of FIG. 1.
Figure 6B:
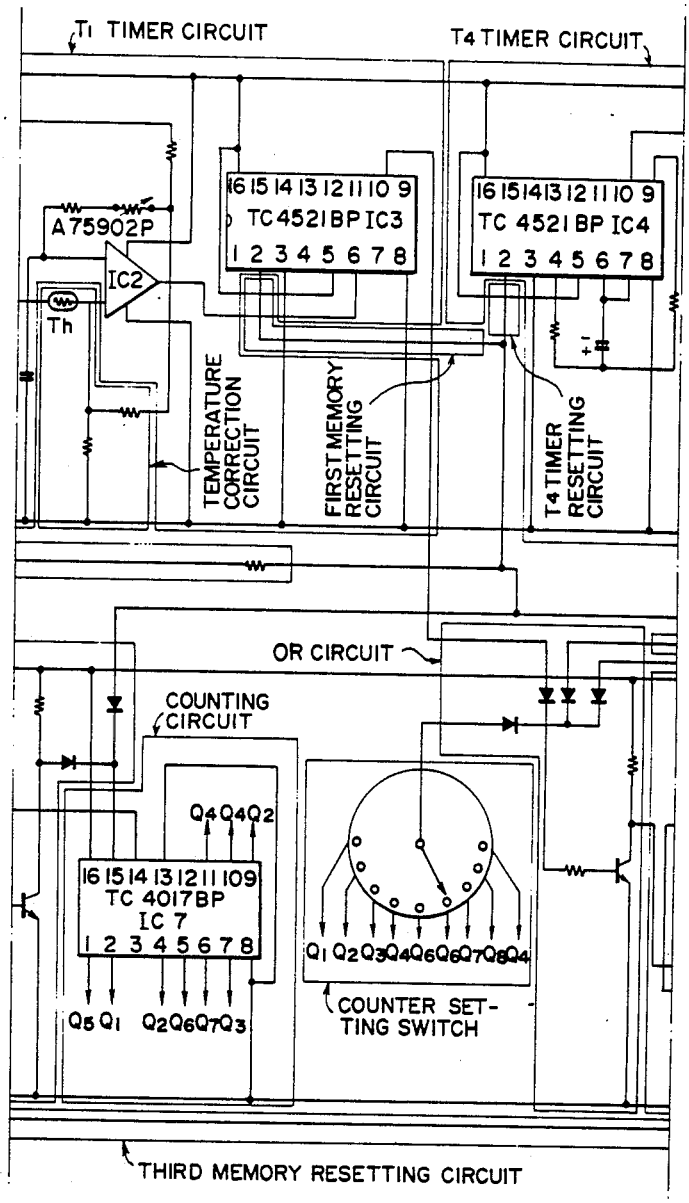
Figure 6C:
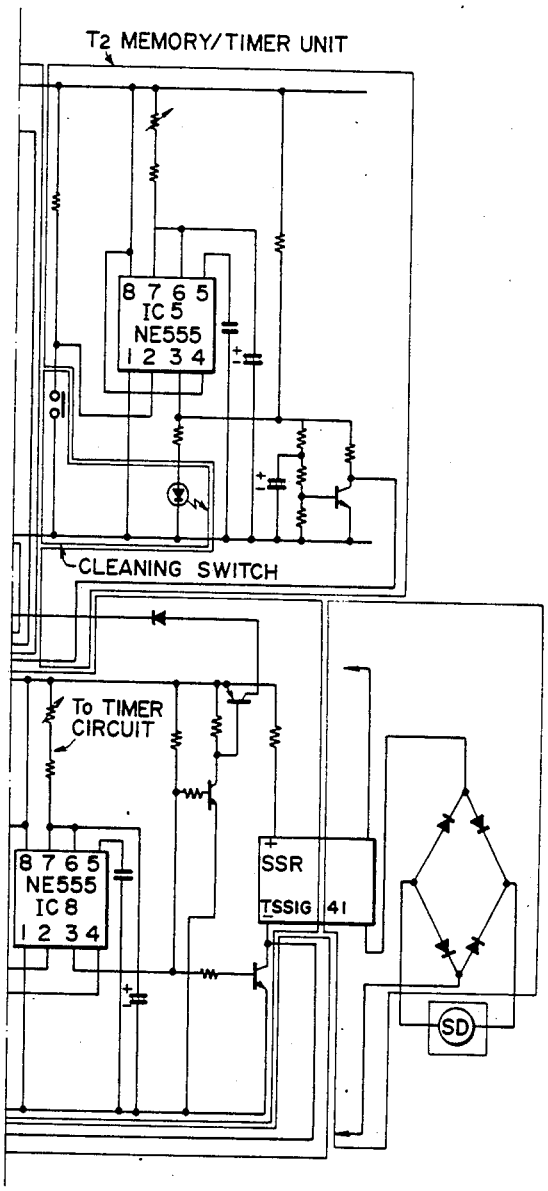

FIGS. 5 and 6 show the time chart of the operation and the circuitry of the above-mentioned embodiment of the present invention respectively.

The provision of the switching unit c-3 for cleaning operation is advantageous, however, the control unit c need not necessarily be provided with the switching unit c-3. Any suitable circuit may be employed as the control unit, however, the employment of a microcomputer provides a compact control unit at a reduced cost.

Figure 8:
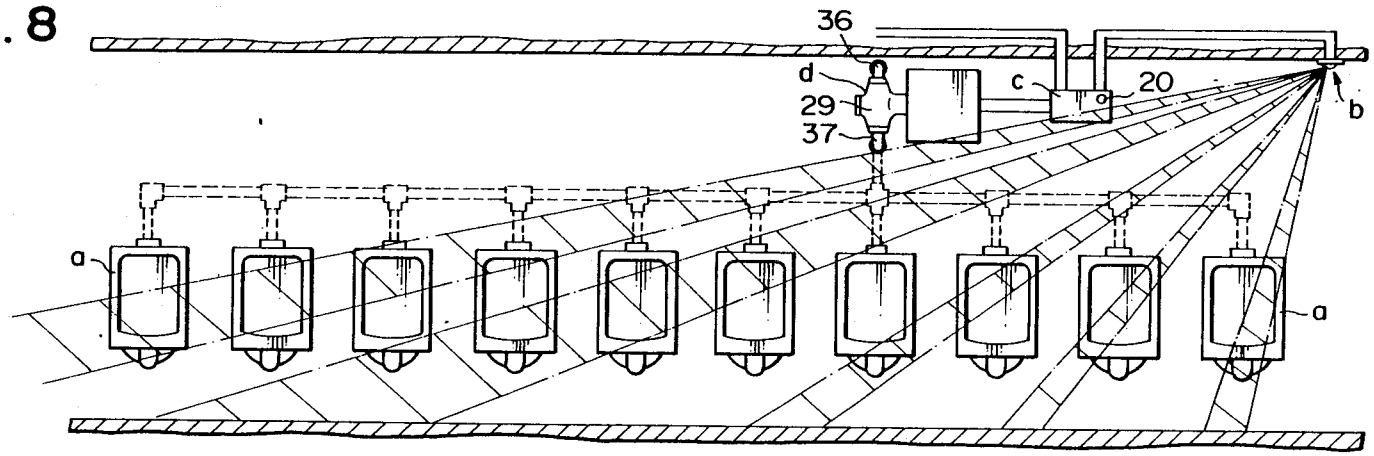
FIG. 8 is a schematic illustration showing a lavatory hopper flushing apparatus, in a second embodiment, according to the present invention.

FIG. 8 shows a second embodiment of the present invention. This embodiment employs a so-called pyroelectric infrared sensor which has a pyroelectric element made of a Lead Titanate-Zirconate ceramic capable of sensing far infrared rays emitted from a human body as the sensing element of the sensing unit b, in which the second embodiment is different from the first embodiment which employs a photoelectric sensor of the reflected light measuring type.

Figure 9:
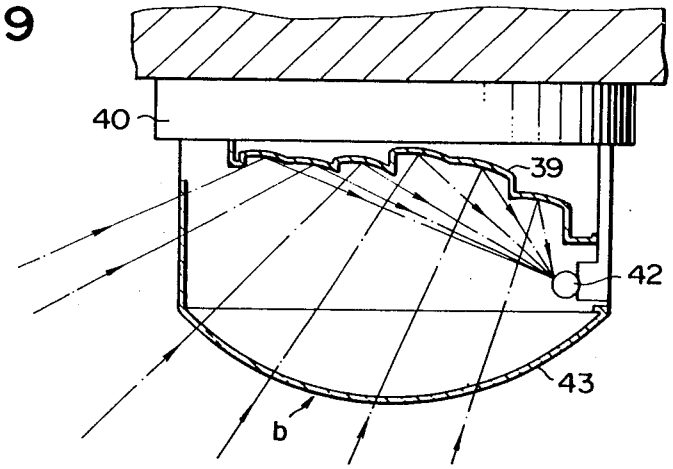
FIG. 9 is a schematic sectional view of the sensor unit of the second embodiment of the present invention.
Figure 10:
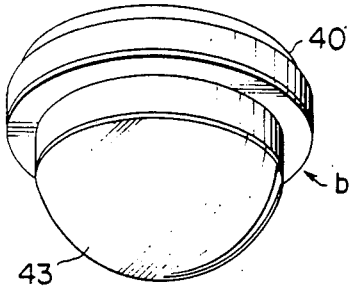
FIG. 10 is a perspective view of the sensor unit of FIG. 9.
Figure 11:
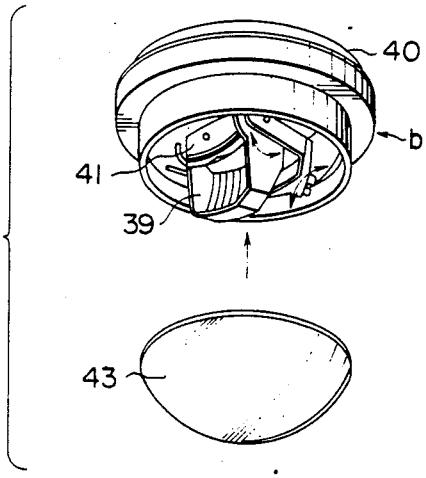
FIG. 11 is an exploded perspective view of the sensor unit of FIG. 10.

The sensing unit b having the pyroelectric infrared ray sensor condenses the infrared rays radiated from a person by means of a concave mirror 39 on the light receiving surface of the pyroelectric element to increase the energy density on the light receiving surface. The concave mirror 39 is attached to the lower side of a base 40 which is attached to the ceiling. A sensor module 41 having the pyroelectric element is disposed opposite the concave mirror 39. As shown by a scematic sectional view in FIG. 9, the concave mirror 39 is formed of a plurality of curved mirrors each having a sectional shape of a circular arc of a curvature differing from those of others so that the infrared rays radiated from a person using any one of a plurality of lavatory hoppers a can be forcused on the light receiving surface of the pyroelectric element 42. Thus, a single sensor unit b covers the entire detection zone as shown in FIG. 8. As shown in FIG. 11, the sensor module 41 and the concave mirror 39 are capable of being turned in two directions so that the disposition of the sensor module 41 and the concave mirror can be adjusted appropriately so as to cover the detection zone. The sensor module 41 and the concave mirror 39 are covered with a cover 43 made of an infrared-transmissive material such as polypropylene.

Figure 12:
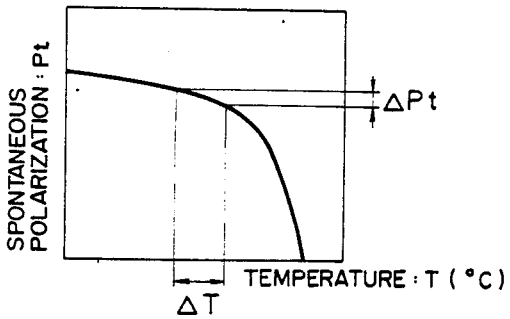
FIG. 12 is a graph for assistance in explaining the function of the sensor unit of FIG. 9.

The far infrared rays radiated from a person standing in front of any one of the lavatory hoppers a and received by the pyroelectric element 42 changes into heat on the surface of the pyroelectric element 42 to heat the pyroelectric element. The temperature change ($\Delta T$) causes the magnitude of spontaneous polarization ($\Delta Pt$) of the pyroelectric element 42 (FIG. 12) and an electric charge is produced. This electric charge is converted into a detection signal by means of an electric circuit such as an amplifier.

The employment of a pyroelectric infrared sensor as the sensing element of the sensing unit b enables the sensing unit b to cover a plurality of lavatory hoppers a for detecting the use of the same, reduces the cost of installation, eliminates the variation of detecting distance and blind zone, and ensures the detection of use of the lavatory hopper.

Figure 13:
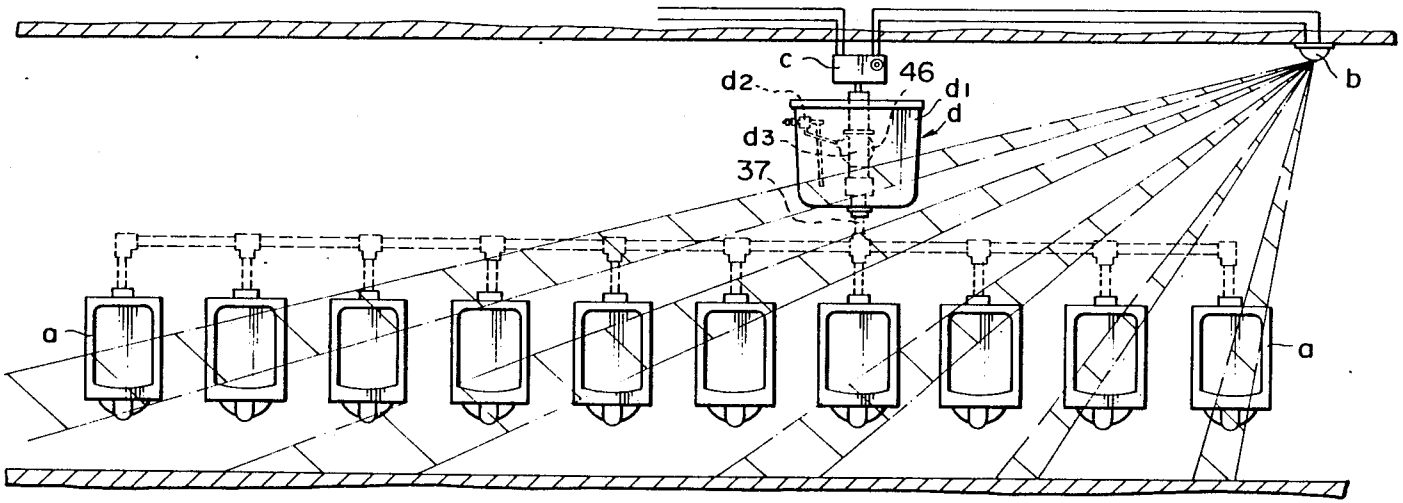
FIG. 13 is a schematic illustration showing a lavatory hopper flushing apparatus, in a third embodiment, according to the present invention.

FIG. 13 shows a third embodiment of the present invention. This embodiment is basically the same as the second embodiment, except that the water supply unit d of this embodiment differs from that of the second embodiment employing an electromagnetic flush valve.

The water supply unit d of the third embodiment comprises a tank $d_1$, a water supply valve $d_2$ for supplying water to the tank $d_1$, a discharge valve $d_3$ for supplying the water contained in the tank $d_1$ to the lavatory hoppers a therethrough, and an electric driving unit $d_4$ for operating the discharge valve $d_3$.

In the exemplary configuration as shown in FIG. 13, the tank d is a so-called high tank attached to an upper part of the wall of the lavatory. The water supply valve $d_2$ and the discharge valve $d_3$ are attached to an upper part of the side wall 44 and the bottom wall 45 of the tank $d_1$ respectively. The water supply valve $d_2$ is connected to a water supply source, while the discharge valve $d_3$ is connected to the lavatory hoppers a. The water supply valve $d_2$ is a well-known ball tap having a float 46 and a valve 47 whose opening and closing are controlled by the depression and elevation respectively of the float 46. The float 46 moves down with the depression of the water level in the tank $d_1$ to open the valve 47 so that water is supplied to the tank $d_1$, while the float 46 moves up with the elevation of the water level in the tank $d_1$ to stop supplying water.

The discharge valve $d_3$ is fitted in a discharge opening 48 formed in the bottom wall 45 of the tank $d_1$. The discharge valve $d_3$ has a valve unit 51 including a discharge valve seat 49*a* provided on a base 49 and a discharge valve element 50*a* provided at the lower end of an operating rod 50.

The base 49 is a practically cylindrical member made of a synthetic resin, such as ABS resin, integrally having an annular discharge valve seat 49*a* protruding from the inner circumference of the lower end thereof, a plurality of through holes 49*b* formed in the circumference of the lower end thereof and a discharge pipe 49*c* extending from the lower end surface thereof and penetrating through and fixed to the bottom wall 45 of the tank $d_1$.

The discharge pipe 49*c* is a practically cylindrical metallic pipe, such as a brass pipe. An outer cylinder 52 of a diameter greater than the outside diameter of the base 49 is attached detachably to the upper end of the discharge pipe 49*c* to regulate the amount of flushing water. A flushing pipe 37 connecting to the lavatory hoppers a is connected to the lower end of the discharge pipe 49*c*.

A frame 53 made of a synthetic resin, such as ABS resin, and having an outside diameter smaller than the inside diameter of the outer cylinder 52 is attached to the outer circumference of the upper part of the base 49, to form a passage 54 between the frame 53 and the outer cylinder 52.

Opposite openings are formed in the intermediate portion of the frame 53. The frame 53 has an upper tubular section 53*a*, a leg section 53*b* and a lower tubular section 53*c*, which are formed integrally from the top to the bottom of the frame 53. An internal thread is formed in the inside surface of the lower end of the lower tubular section 53*c*. Thus the frame 53 is screwed at the lower tubular section 53*c* on the base 49. A container 55 is fitted in the lower tubular section 53*c* of the frame 53.

The container 55 is a double-cylindrical member made of a synthetic resin, such as polypropylene, having an inner cylindrical wall 55*a*, an outer cylindrical wall 55*b* and a bottom wall 55*c* interconnecting the inner cylindrical wall 55*a* and the outer cylindrical wall 55*b*. The lower end of the outer cylindrical wall 55*b* is fitted fixedly on the upper end of the base 49. A small drain port 55*d* is formed in the bottom wall 55*c*. A float chamber formed between the inner and outer cylindrical walls 55*a* and 55*b* and the interior space 49*d* of the base 49 communicate by means of the drain port 55*d*.

A hollow annular float 57 having an inside diameter greater than the diameter of the inner cylindrical wall 55*a* and an outside diameter smaller than the diameter of the outer cylindrical wall 55*b* is accommodated in the float chamber 56. The operating rod 50 is inserted slidably through the interior of the inner cylindrical wall 55*a*.

The float 57 is designed so that the buoyance thereof is somewhat greater than the downward force that acts on the operating rod 50 when the valve unit 51 is open and the same is smaller than the downward force including a water pressure acting on the discharge valve element 50*a* and the weight of the operating rod 50 when the valve unit 51 is closed.

The operating rod 50 is a tubular member made of a synthetic resin, such as ABS resin, and functions as an overflow pipe. The operating rod 50 is provided at the lower end thereof with the disk-shaped discharge valve element 50*a* made of an elastic sheet, such as a rubber sheet. The valve element 50*a* is adapted to be seated on the discharge valve seat 49*a* of the base 49. The valve element 50*a* and the valve seat 49*a* constitute the valve unit 51.

A stopper 58 having the form of a skirt is attached to the outer circumference of the intermediate section of the operating rod 50 so as to be inserted into the float chamber 56. A cylindrical overflow mouth 59 having an inside diameter greater than that of the operating rod 50 is attached to the upper end of the operating rod 50. A ring 60 is fixed to the inside surface of the intermediate portion of the overflow mouth 59.

The ring 60 is a disk-shaped member made of a synthetic resin, such as polyacetal, and having a center hole 62 for receiving a plunger 61 therethrough and a plurality of through holes 63, four through holes, in this embodiment, arranged around the center hole 62. The ring 60 is fixed at the circumference thereof to the inside surface of the intermediate portion of the overflow mouth 59 by means of a stop ring 64.

The plunger 61 consists of a lower rod 61*a* vertically slidable through the center hole 62 of the ring 60 and an upper rod 61*b* disposed within a supporting member and interlocked with the electromagnet 30 of the electric driving unit $d_4$. The rods 61*a* and 61*b* are interconnected with a shaft 61*d* fitted in both the rods 61*a* and 61*b*.

The lower rod 61*a* is a member made of a synthetic resin, such as polyacetal, having a diameter smaller than the inside diameter of the center hole 62 of the ring 60 and provided at the lower end thereof with a flange 61*c* of a diameter greater than the inside diameter of the center hole 62. The lower rod 61*a* is disposed so that a suitable clearance is formed between the upper surface of the flange 61*c* and the lower surface of the ring 60 when the valve unit 51 is closed.

A supporting member 65 is a disk-shaped member made of a synthetic resin, such as polyacetal. The lower portion of the supporting member 65 is fitted in the tubular section 53*a* of the frame 53. A plurality of screws are screwed through the frame 53 into the supported member 65 to fixe the supporting member 65 and the frame 53 together. A cavity 65*a* of a circular cross section is formed in the central portion of the upper part of the supporting member 65. The upper rod 61*b* of the plunger 61 is disposed within the cavity 65*a*. A through hole 65*b* for slidably receiving the lower rod 61*a* therethrough is formed in the bottom wall of the supporting member 65. The electromagnet 30 of the electric driving unit $d_4$ for operating the discharge valve $d_3$ is attached to the supporting member 65 so as to close the upper opening of the cavity 65*a*. A cover 67 is attached to the supporting member 65 so as to cover the upper portion of the supporting member 65 and the electromagnet 30.

On the other hand, the upper portion of the upper rod 61*b* of the plunger 61 is inserted into the electromagnet 30. The plunger 61 is elevated for an appropriate time when the electromagnet 30 is energized. In this embodiment, the appropriate time is one second.

A bottomed tubular elastic membrane 68 made of an elastic material, such as rubber, is fitted on the upper rod 61*b* so as to extend over the inside surface of the cavity 65*a* in order to prevent the intrusion of water and vapor into the electromagnet 30.

A strainer 70 is extended between a plurality of the screws 66, four screws, in this embodiment, fixing the supporting member 65 to the upper tubular section 53*a* of the frame 53 and a stop ring 69 fixed to the upper end surface of the lower tubular section 53*c* of the frame 53. The strainer is a tubular metallic net, such as a tubular stainelss net. The upper end of the strainer 70 is fixed to a flanged bush 71 fixed by the screws 66. The two-split stop ring 69 is fitted in the lower end of the strainer 70.

The stop ring 69 is a cylindrical member made of a synthetic resin, such as ABS resin, having an inside diameter practically the same as the inside diameter of the lower tubular section 53*c* of the frame 53 and an outside diameter practically the same as the inside diameter of the strainer 70. Stopping projections 69*a* are formed on the inner circumference of the upper end of the stop ring 69 so as to project into a pair of the opposite openings 53*d* formed in the intermediate section of the frame 53. A flange 69*b* extending outward is formed at the lower end of the stop ring 69. Thus the stop ring 69 has a cross section similar to that of a flanged cup of a flat bottom. The stop ring 69 is split into two indentical parts. When assembled, the respective lower surfaces of the stopping projections 69*a* are in contact with the upper end surface of the lower tubular section 53*c* of the frame 53. Thus, the strainer 70 is held by the lower surface of the flanged bush 71 fixed by the screws 66 and the upper surface of the flange 69*b*.

Figure 14:
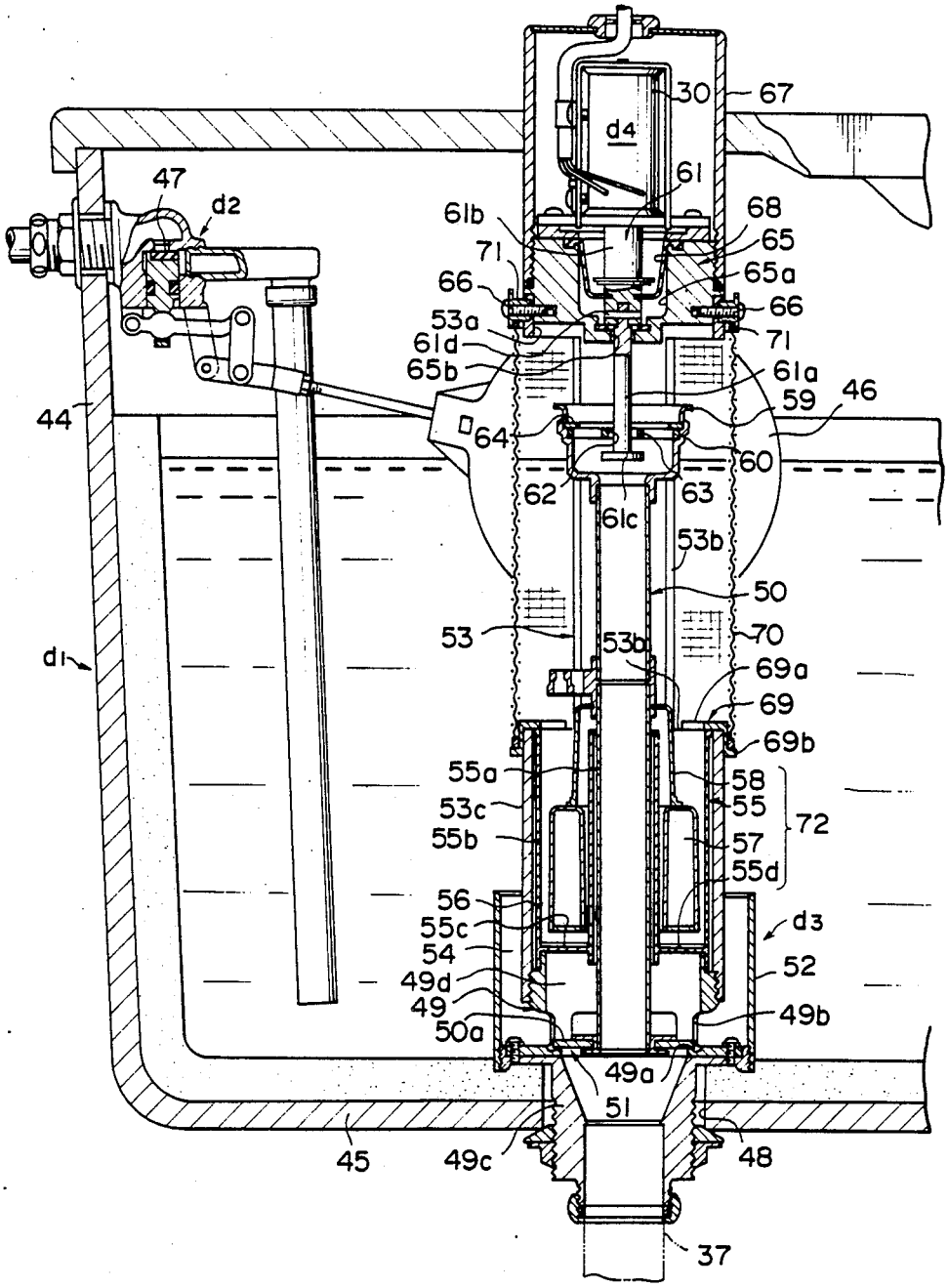
FIG. 14 is a sectional view of the water supply unit of the third embodiment.

Normally, the valve unit 51 of the discharge valve $d_3$ is closed as shown in FIG. 14 and the upper surface of the water reserved in the tank is located somewhat below the upper end of the overflow mouth 59 fixed to the upper end of the operating rod 50.

Figure 15:
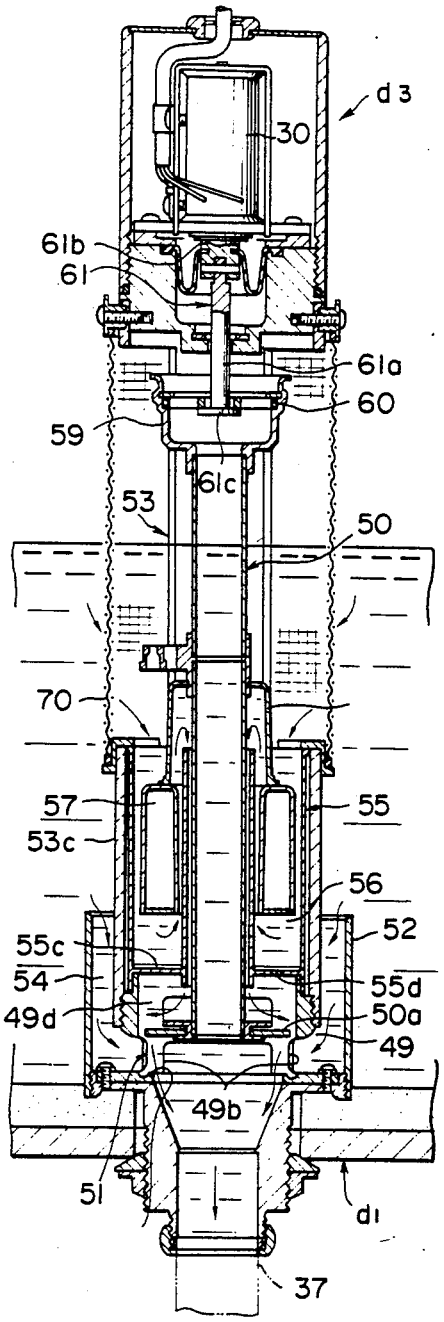
FIGS. 15 to 18 are sectional views of a principal component of the water supply unit of FIG. 14, namely, a water discharge valve, for assistance in explaining the function of the same.

When the output control unit c-5 of the control unit c provides an output signal, and there by the electromagnet 30 is energized, the upper rod 61*b* and the lower rod 61a of the plunger 61 are pulled up and the operating rod 50 is pulled up through the ring 60 and the overflow mouth 59 by the flange 61*c* formed at the lower end of the lower rod 61*a* to open the valve unit 51. Then, the major part and the minor part of the water contained in the tank $d_1$ flow through a passage 54 between the lower tubular section 53*c* of the frame 53 and the outer cylinder 52 and the through holes 49*b* of the base 49, and through the strainer 70, the float chamber 56, the drain port 55*d* formed in the bottom wall 55*c* of the container 55, the interior space 49*d* of the base 49 respectively. Thus the water contained in the tank $d_1$ is discharged from the valve unit 51 and supplied through the flushing pipe 37 to the lavatory hoppers a, and thereby the water level in the tank starts being depressed rapidly (FIG. 15).

Figure 16:
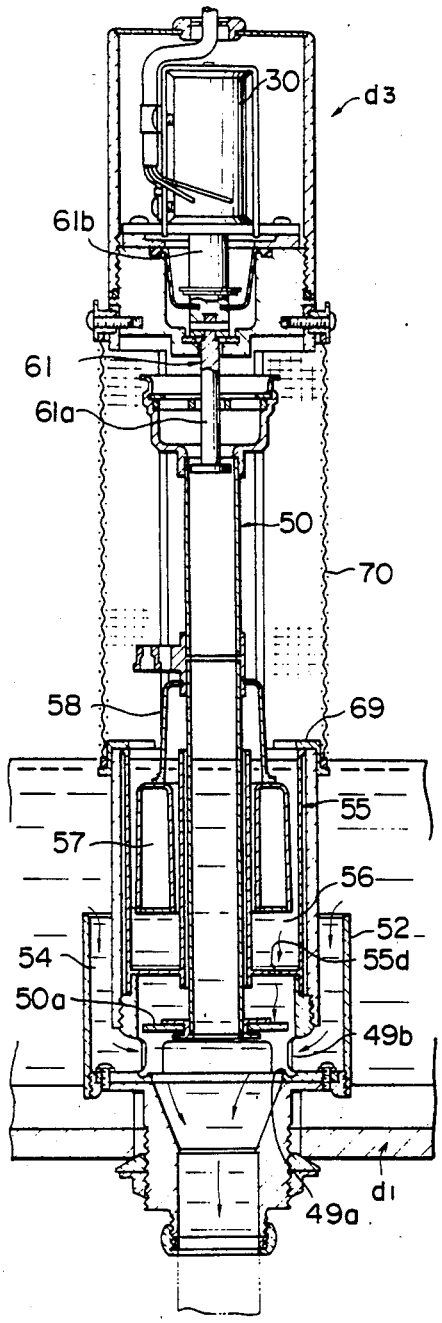

After the water level has been depressed below the lowermost part of the strainer 70, namely, below the upper surface of the stop ring 69, since the passage area of the drain port 55*d* is very small as compared with that of the through holes 49*b*, the lowering rate of the water level in the float chamber 56 is lower than the lowering rate of the water level in the other portion, and hence the water level in the float chamber 56 is always higher than that in other portion (FIG. 16).

Figure 17:
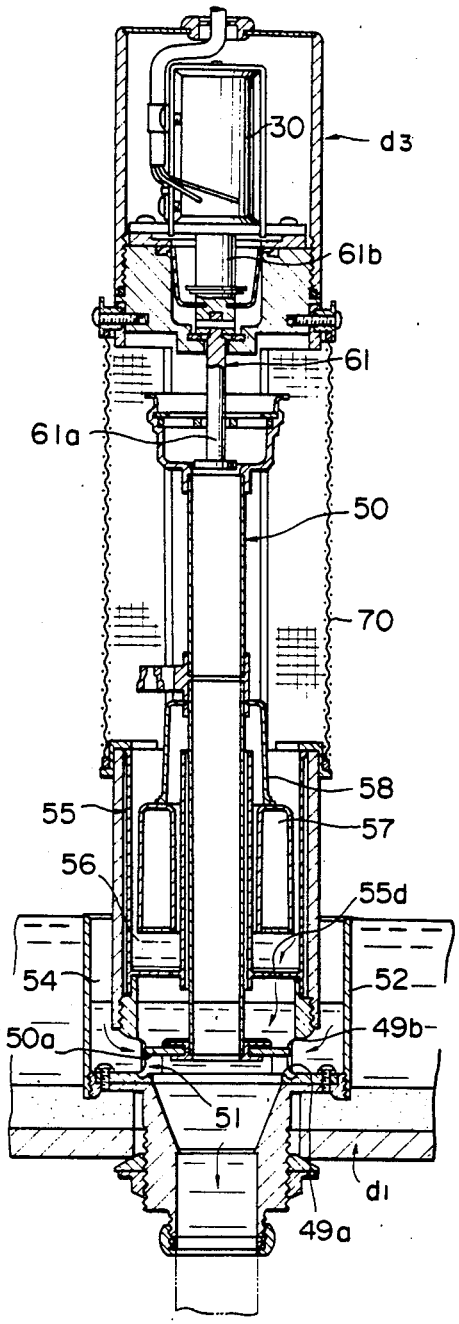

Water still remains in the float chamber 56 after the most part of the water contained in the tank $d_1$ has been discharged into the lavatory hoppers, and the water level in the tank $d_1$ except the water level in the float chamber 56 has been depressed to the upper end of the outer cylinder 52 and a predetermined amount of water has been discharged into the lavatory hoppers. Therefore, the float 57 in the float chamber 56 is floating, and thereby the operating rod 50, hence the discharge valve element 50*a*, is suspended through the stopper 58 by the float 57 so that the valve unit 51 is kept open (FIG. 17).

Figure 18:
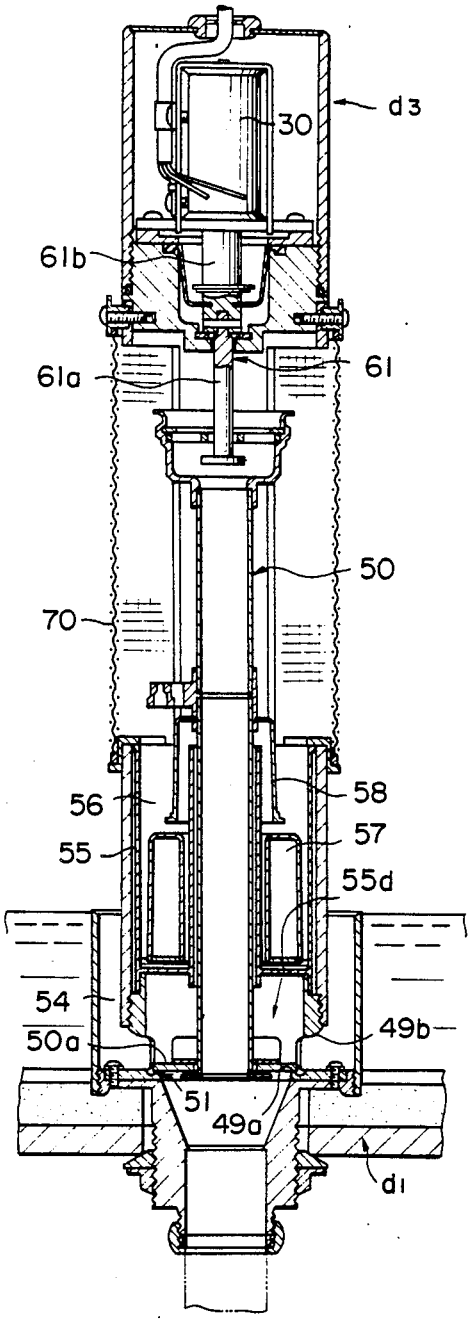

As the water in the float chamber 56 is drained through the drain port 55*d*, the float 57 is lowered, and hence the discharge valve element 50*a* approaches the discharge valve seat 49*a*. Finally, the discharge valve element 50*a* is seated on the discharge valve seat 49*a* to close the valve unit 51. Thus a single flushing cycle is completed (FIG. 18).

Thus the discharge valve $d_3$ closes with a small time lag after a predetermined amount water has been discharged from the tank. The container 55, the drain port 55*d*, the float 57 and the stopper 58 constitute a delaying means 72 for delaying the closing of the discharge valve $d_3$.

Once the discharge valve of the water supply unit d having the above-mentioned construction is opened, the discharge valve is kept open by the agency of the float, and hence the lavatory hoppers are flushed always with a practically fixed amount of water, and thereby the lavatory hoppers are washed surely and satisfactorily.

The opening duration of the discharge valve can readily be regulated by adjusting the passage area of the drain port of the delaying means and the capacity of the container.

Once the discharge valve is opened, the discharge valve element is held at the open position by the buoyancy of the float. Therefore, the electromagnet needs to be energized only for a short time and to be capable of generating only a small electromagnetic force, and hence even a small electromagnet functions satisfactorily.

The water supply unit d of the third embodiment need not necessarily be used in combination with the sensor unit c employing a pyroelectric infrared sensor, but may be used in combination with the sensor unit employing a photoelectric sensor of the first embodiment.

We claim:

1. A lavatory hopper flushing apparatus comprising:

a sensor unit capable of detecting the use of any one of a plurality of lavatory hoppers arranged side by side, and providing a detection signal upon the detection of the use of any one of the lavatory hoppers;

a control unit capable of being actuated by the detection signal;

a water supply unit capable of being activated by the control unit so as to flush all the lavatory hoppers simultaneously;

wherein the control unit comprises, a counter control unit comprising a memory circuit that is set by a detection signal and remains set even in the presence of another detection signal until being reset, a timer circuit, a counting circuit and a memory resetting circuit, said timer circuit actuated by setting of said memory circuit and providing a signal to said counting circuit and said memory resetting circuit upon the termination of a timing operation, said counting circuit counting signals from the timer circuit, and said memory resetting circuit resetting the memory circuit upon receiving a signal from the timer circuit, said counting circuit providing an output signal when the counted value of the counting circuit reaches a predetermined number; and an output control unit which provides an output signal to actuate the water supply unit, upon the reception of the output signal given by the counter control unit.

2. A lavatory hopper flushing apparatus according to claim 1, wherein the sensor of the sensor unit is a pyroelectric infrared sensor which changes the infrared rays radiated from a person who uses any one of the lavatory hoppers into heat by means of a pyroelectric element and uses the electricity generated by the pryoelectric element due to the temperature change of the same caused by the heat as a detection signal.

3. A lavatory hopper flushing apparatus according to claim 1, wherein the water supply unit has a tank, a water supply valve for supplying water to the tank, a discharge valve for supplying the water contained in the tank to the lavatory hoppers and an electric driving unit for driving the discharge valve, and the electric driving unit is actuated by an output signal given thereto by the output control unit.

4. A lavatory hopper flushing apparatus comprising:

a sensor unit capable of detecting the use of any one of a plurality of lavatory hoppers arranged side by side, and providing a detection signal upon the detection of the use of any one of the lavatory hoppers;

a control unit capable of being actuated by the detection signal;

a water supply unit capable of being activated by the control unit so as to flush all the lavatory hoppers simultaneously;

wherein the control unit comprises, a counter control unit comprising a memory circuit that is set by a detection signal and remains set even in the presence of another detection siganl until being reset, a timer circuit, a counting circuit and a memory resetting circuit, said timer circuit actuated by setting of said memory circuit and providing a signal to said counting circuit and said memory resetting circuit upon the termination of a timing operation, said counting circuit counting signals from the timer circuit, and said memory resetting circuit resetting the memory circuit upon receiving a signal from the timer circuit, said counting circuit providing a first output signal when the counted value of the counting circuit reaches a predetermined number;

a timer control unit which has a second timer circuit actuated by the detection signal and generates a second output signal upon the termination of a timing operation of the second timer circuit; and an output control unit which provides an output signal to actuate the water supply unit upon the reception of the first output signal given by the counter control unit or the second output signal given by the timer control unit.

5. A lavatory hopper flushing apparatus according to claim 4, wherein the second timer circuit includes a temperature correction circuit which changes the time of duration of the timing operation of the second timer circuit according to the existing temperature of the lavatory.

6. A lavatory hopper flushing apparatus according to claim 4, wherein the sensor of the sensing unit is a pyroelectric infrared sensor which sensing the infrared rays radiated from a person who uss any one of the lavatory hoppers into heat by means of a pyroelectric element and uses the electricity generated by the pyroelectric element due to the temperature change of the same caused by the heat as a detection signal.

7. A lavatory hopper flushing apparatus according to claim 4, wherein the water supply unit has a tank, a water supply valve for supplying water to the tank, a discharge valve for supplying the water contained in the tank to the lavatory hoppers and an electric driving unit for driving the discharge valve, and the electric driving unit is actuated by an output signal given thereto by the output control unit.

8. A lavatory hopper flushing apparatus according to claim 4, wherein:

the sensing unit comprises a pyroelectric infrared sensor which changes the infrared rays radiated from a person who uses any one of the lavatory hopper into heat by means of a pyroelectric element and uses the electricity generated by the pyroelectric element due to the temperature change of the same caused by the heat as a detection signal;

the timer control unit includes a temperature correction circuit which changes the time of duration of the timing operation of the second timer circuit according to the existing temperature of the lavatory; and the water supply unit comprises a tank, a water supply valve for supplying water to the tank, a discharge valve for supplying the water contained in the tank to the lavatory hoppers, and an electric driving unit for driving the discharge valve, said electric driving unit actuated by an output signal given thereto by the output control unit.

9. A lavatory hopper flushing apparatus comprising:

a sensor unit capable of detecting the use of any one of a plurality of lavatory hoppers arranged side by side, and providing a detection signal upon the detection of the use of any one of the lavatory hoppers;

a control unit capable of being actuated by the detection signal;

a water supply unit capable of being driven by the control unit so as to flush all the lavatory hoppers simultaneously;

wherein the control unit comprises, plural linked control units including a counter control unit which generates a first output signal, a timer control unit which generates a second output signal, a protective timer control unit which generates a third output signal, and an output control unit which generates a fourth output signal to actuate the water supply unit by generation of the first, second or third ouput signal, said counter control unit comprising a memory circuit which is set by a detection signal and remains set even in the presence of another detection signal until being reset, a first timer circuit, a counting circuit and a memory resetting circuit, said first timer circuit actuated by setting of said memory circuit and providing a signal to said counting circuit and said memory resetting circuit upon the termination of a timing operation, said counting circuit counting signals from the timer circuit, and said memory resetting circuit resetting the memory circuit upon receiving a signal from the timer circuit, said counting circuit generating said first output signal when the counted value of the counting circuit reaches a predetermined number;

said timer control unit comprising a second timer circuit actuated by the detection signal and generating said second output signal upon the termination of a timing operation of the second timer circuit; and said protective timer control unit comprising a third timer circuit which is reset at every time of generation of said fourth output signal and then actuated again, said protective timer control unit generating said third output upon the termination of a timing operation of the third timer circuit.

10. A lavatory hopper flushing apparatus according to claim 9, wherein the second timer circuit has a temperature correction circuit which changes the time of duration of the timing operation of the second timer circuit according to the existing temperature of the lavatory.

11. A lavatory hopper flushing apparatus according to claim 9, wherein the water supply unit has a tank, a water supply valve for supplying water to the tank, a discharge valve for supplying the water contained in the tank to the lavatory hoppers and an electric driving unit for driving the discharge valve, and the electric driving unit is actuated by an output signal given by the output control unit.

12. A lavatory hopper flushing apparatus according to claim 9, wherein:

the sensor unit comprises a pyroelectric infrared sensor which changes the infrared rays radiated from a person who uses any one of the lavatory hoppers into heat by means of a pyroelectric element and uses the electricity generated by the pyroelectric element due to the temperature change thereof caused by the heat as a detection signal;

the timer control unit of the control unit includes a temperature correction circuit which changes the time of duration of the timing operation of the second timer circuit according to the existing temperature of the lavatory; and the water supply unit comprises a tank, a water supply valve for supplying water to the tank, a discharge valve for supplying the water contained in the tank to the lavatory hoppers and an electric driving unit for driving the discharge valve, said electric driving unit actuated by an output signal given thereto by the output control unit.

13. A lavatory hopper flushing apparatus according to claim 9, wherein the sensor of the sensor unit is a pyroelectric infrared sensor which changes the infrared rays radiated from a person who uses any one of the lavatory hoppers into heat by means of a pyroelectric element and uses the electricity generated by the pyroelectric element due to the temperature change of the same caused by the heat as a detection signal.

* * * * *